United States Patent [19]

Clery, Jr. et al.

[11] 4,429,901

[45] Feb. 7, 1984

[54] POSTING BOARD

[75] Inventors: Howard K. Clery, Jr., Brynmawr; Scott R. Penniman, Lansdale, both of Pa.

[73] Assignee: Rep Industries Inc., Lansdale, Pa.

[21] Appl. No.: 280,727

[22] Filed: Jul. 6, 1981

[51] Int. Cl.[3] ..... B41L 3/00

[52] U.S. Cl. ..... 282/29 B; 283/65; 283/66 R; 402/19; 402/21

[58] Field of Search ..... 282/29 R, 29 A, 29 B, 282/29 C; 283/63 A, 64, 65, 66 R; 402/19, 21, 22, 26, 29

[56] References Cited

U.S. PATENT DOCUMENTS

| | | | |
|---|---|---|---|
| 2,485,513 | 10/1949 | Straus . | |
| 2,623,762 | 12/1952 | Nelson . | |
| 2,637,570 | 5/1953 | Griffin . | |
| 2,681,237 | 6/1954 | Brodtmann . | |
| 2,696,393 | 12/1954 | Fitzgerald . | |
| 2,722,436 | 11/1955 | Pfeiffer . | |
| 2,861,819 | 11/1958 | Apol | 282/29 B |
| 2,976,062 | 3/1961 | Drechner . | |
| 3,073,625 | 1/1963 | Petit . | |
| 3,141,684 | 7/1964 | Haber | 282/29 R X |
| 3,201,038 | 8/1965 | Harris | 402/19 X |
| 3,556,562 | 1/1971 | McGough | 282/29 B X |
| 4,178,710 | 12/1979 | Schmid | 402/21 X |

FOREIGN PATENT DOCUMENTS

| | | | |
|---|---|---|---|
| 495708 | 11/1950 | Belgium | 402/21 |
| 358065 | 12/1961 | Switzerland | 402/21 |

*Primary Examiner*—Paul A. Bell
*Attorney, Agent, or Firm*—Seidel, Gonda & Goldhammer

[57] ABSTRACT

A check posting board is provided for aligning checks on top of a business form with duplicating material therebetween, whereby writing made on the check is duplicated on appropriate lines and columns of the business form. The board comprises a generally flat writing surface having along one edge thereof a plurality of radially spaced aligning posts by which the business form and checks may be aligned by placing discrete holes in the business form over said posts and the placing discrete holes in the checks over said posts. An elongated main rail is provided adjacent to and extending substantially the length of the writing surface. The rail has on an upper surface thereof two spaced parallel slots for receiving a slidable check retaining carriage. The check retaining carriage has means for retaining a stack of checks by the stub ends thereof in a manner in which the bottom check of the stack may be disposed over the business form and aligned therewith by placing discrete holes in the check stub over each of at least two of the posts. The other checks of the stack may be flipped back away from the business form. The check retaining carriage makes a sliding engagement with the slots of the main rail, whereby a check may be aligned in any one of a multiplicity of spaced positions over the business form. In a preferred embodiment, the cover plate is provided for the stack of checks. Also provided is a column of numbered positions along the main rail to align therewith corresponding numbered lines on the business form. The numbered positions may be viewed through a specially provided hole in a check to facilitate identifying the line on the business form over which the check is aligned. There may also be provided a binder cover or protective material covering the posting board.

6 Claims, 5 Drawing Figures

POSTING BOARD

BACKGROUND OF THE INVENTION

This invention relates to an improved check posting board. Posting, in the bookkeeping definition of the word, relates broadly to the transfer of information regarding individual transactions onto a ledger. Thus, the present invention is directed primarily to an improved posting board for transferring information from checks onto a ledger, and the illustrated preferred embodiment shows such a device. However, it will be understood by persons familiar with bookkeeping transactions that the posting board disclosed and claimed herein may be used with a variety of bookkeeping and accounting forms. While the terms "check" and "ledger" may be used hereinafter for clarity, it should be understood that the claimed invention covers all equivalent business transactions wherein information regarding an individual transaction is transferred to the appropriate lines and columns of a separate summary sheet.

It is well known in the art to provide posting boards of this type, wherein checks or other individual transaction forms are aligned on top of a ledger or summary form, with duplicating material therebetween. Entries made on the checks or individual transaction forms are thereby automatically duplicated on the appropriate lines and columns of the underlying ledger or summary sheets.

The present invention is directed to an improved posting board of type described above. It is an object of the present invention to provide an improved posting board wherein a stack of checks is retained on a slidable carriage. The slidable carriage may be moved along the edge of the ledger into a rough alignment position, and then a single check from the stack may be precisely aligned with the corresponding lines and columns of the ledger by a system of alignments posts and holes. This and other advantages of the present invention will be clearly understood upon reading the detailed description which follows.

BRIEF DESCRIPTION OF THE INVENTION

A check posting board is provided for aligning checks on top of a business form with duplicating material therebetween, whereby writing made on the check is duplicated on appropriate lines and columns of the business form. The board comprises a generally flat writing surface having along one edge thereof a plurality of spaced aligning posts, by which the business form and checks may be aligned by placing specially provided holes in the business form over said posts and the placing specially provided holes in the check stubs over said posts. An elongated main rail is provided adjacent to and extending substantially the length of the writing surface. The rail has on an upper surface thereof two spaced parallel slots for receiving a slidable check retaining carriage. The check retaining carriage has means for retaining a stack of checks by the stub ends thereof in a manner in which the bottom check of the stack may be disposed over the business form and aligned therewith by placing specially provided holes in the check over each of at least two of the posts. The other checks of the stack may be flipped back away from the business form. The check retaining carriage makes a sliding engagement with the slots of the main rail, whereby a check may be aligned in any one of a multiplicity of spaced positions over the business form.

In a preferred embodiment, a cover plate is provided for the stack of checks. Also provided is a column of numbered positions along the main rail to align therewith corresponding numbered lines on the business form. The numbered positions may be viewed through a specially provided hole in the check to facilitate identifying the line on the business form over which the check is aligned. There may also be provided a binder cover of protective material covering the posting board.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DISCLOSURE

Figures 1, 5:
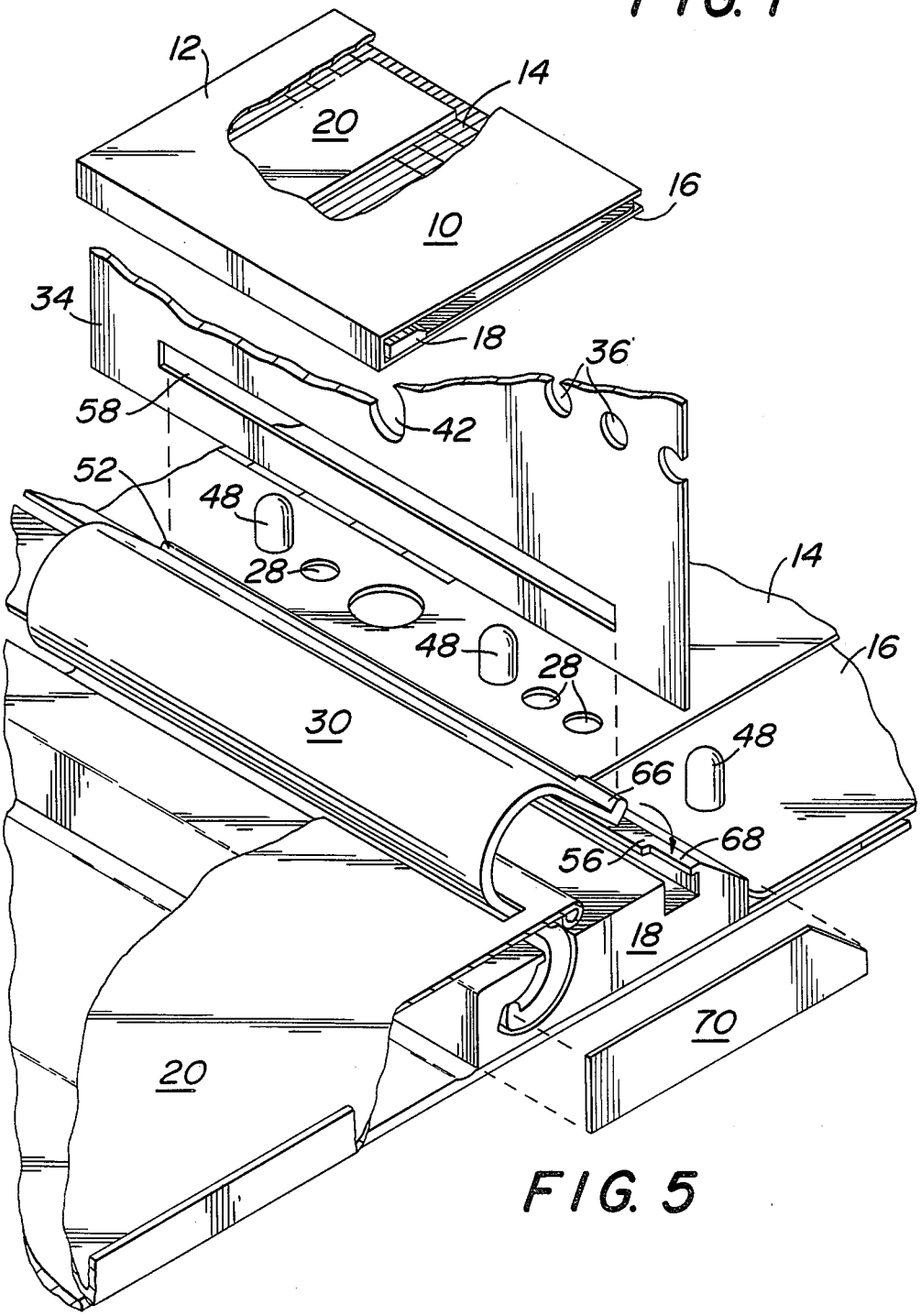
FIG. 1 is a perspective view of a posting board according to the present invention, having a portion of the cover thereof cut away to reveal the check cover plate and the business form.
FIG. 5 is a partial perspective view of the present invention with portions exploded and portions cut away for purposes of illustration.

Referring now to the drawings wherein like numerals indicate like elements, there is shown in FIG. 1 a posting board according to the present invention designated generally as 10. Posting board 10 may have a binder cover 12 of protective material such as leather, pressed cardboard, or synthetic material. Cover 12 is not essential for the operation of posting board 10, but is preferably provided in order to shield the posting board, and the checks and business forms used therewith, from dirt and wear.

A portion of cover 12 is cut away for purposes of illustration to reveal a business form 14. Business form 14 in the embodiment shown is a ledger for recording an ordered summary of information regarding individual business transactions in which checks are issued. Thus, ledger 14 may be a payroll ledger, an accounts payable ledger, or any of a variety of business forms in which individual transactions are recorded in an ordered summary. Form 14 comprises a plurality of spaced lines for the individual transactions, and a plurality of spaced columns dividing each line into segments in which relevant information concerning the individual transaction is recorded. Such information regarding a check transaction may include the name of the payee, the date, the amount of payment, and the purpose for which payment is made.

A flat writing surface 16 is provided to underlie the business form 14. Form 14 is preferably a generally rectangular aluminum sheet with rounded corners. A main rail 18 is provided along the inside edge of writing surface 16, and extends substantially the length of the inside edge of writing surface 16. The function of main rail 18 will be more fully understood below. A check cover plate 20 is provided to overlie and protect a stack of checks. Cover plate 20 is preferably an aluminum plate with three shallow vertical sides to encompass the stack of checks when the posting board is in the closed position as shown in FIG. 1.

Figure 2:
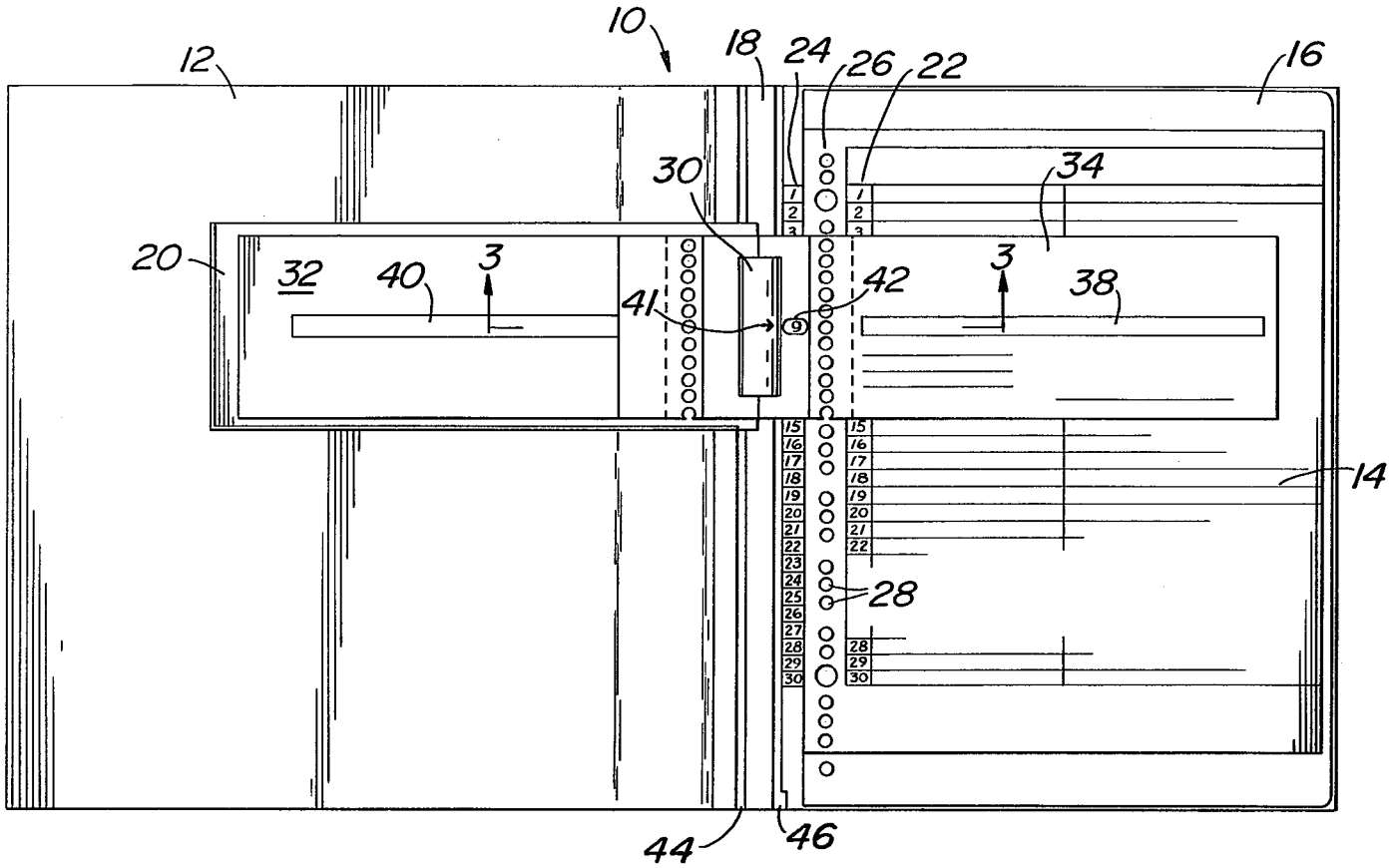
FIG. 2 is a top view of an open posting board according to the present invention, with business form and checks in position for making a written entry.

Turning now to FIG. 2, posting board 10 is shown in an open position, ready for use. Near the leftmost edge business form 14 is a column 22 of sequential numbers corresponding to individual lines on form 14. Along the rightmost edge of main rail 18 is a second column 24 of sequential numbers, preferably the same in number as column 22. Form 14 may be aligned in proper position on writing surface 16 by aligning the corresponding numbers in columns 22 and 24.

Business form 14 is specially provided with a column 26 of regularly spaced holes 28. Holes 28 are used to hold form 14 in alignment on writing surface 16 by placing selected ones of holes 28 over posts projecting upwardly from writing surface 16. Checks to be used with posting board 10 are also specially provided with spaced holes 36 in their stubs. Selected ones on the holes 36 being placed over the posts to align the checks on top of form 14.

A slidable check retaining carriage 30 is provided to secure a stack of checks 32 by the stub ends thereof. The stack of checks 32 are retained by carriage 30 in a pivotable manner more fully described below, so that the stack 32 may be flipped back to the left as shown in FIG. 2, away from business form 14. The bottom most check 34 of the stack 32 may be placed over business form 14 while still attached to carriage 30, and held in precise alignment by placing selective ones of the specially provided holes 36 over the posts.

On the specially adapted check 34 provided for use with the present invention, the relevent information such as payees name, date, amount of check, and purpose is preferably written in separate segments of a single line 38. Line 38 should be of the same approximate dimensions as the the underlying line on the business form. As shown in FIG. 2, the reverse side of each check preferably has a strip of duplicating material 40 corresponding in size to line 38. Thus, information written on line 38 is automatically duplicated to the underlying business form by duplicating material 40. Alternatively, a separate sheet of duplicating material could be placed over the business form, or a sheet of duplicating material could be provided behind each check.

A single indexing hole 42 is provided in each check stub. A hole 42 is provided to be in horizontal alignment with line 38 and in vertical alignment with column 24, so that the identifying line number of business form 14 may be viewed through hole 42. Thus, hole 42 facilitates the correct alignment of the check 38 over the appropriate line of form 14. An indexing marker 41 may be provided on rail 18.

Two spaced parallel slots, 44 and 46, are provided in main rail 18. Check retaining carriage 30 is engaged in rails 44 and 46 in a slidable manner to be explained more fully below, so that the checks may be moved into the proper position for placing the desired ones of holes 28 over the desired pegs to align the checks with the business form 14. For this reason, slots 44 and 46 should extend substantially the length of main rail 18, or at least extend far enough along rail 18 so that the checks may be placed in alignment over the uppermost and lowermost lines on business form 14.

Figure 3:
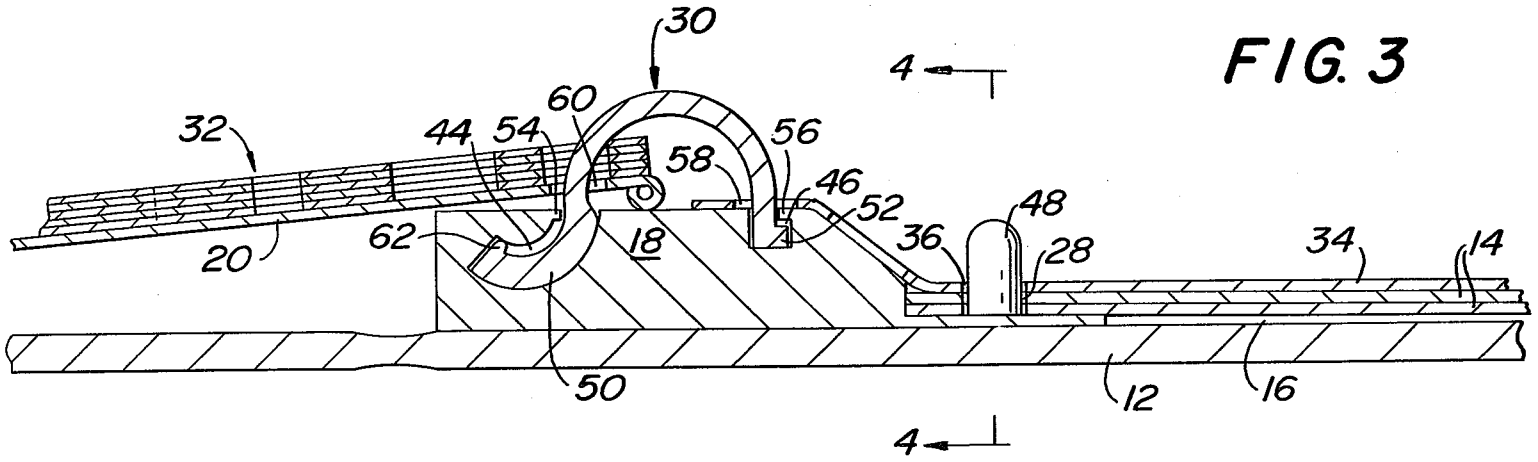
FIG. 3 is a sectional view taken along the line 3—3 in FIG. 2.

Referring now to FIG. 3, there is shown a post 48 which is integral with and projects upward from writing surface 16. Business form 14, herein shown in double thickness, is held in alignment over writing surface 16 by placing one of holes 28 over peg 48. Check 34 is then aligned on top of business form 14 by placing one of holes 36 over peg 48. There are a plurality of pegs 48 provided, with the spacing between pegs 48 preferably such that every check is aligned by placing selected holes 36 over at least two pegs 48.

The features of check retaining carriage 30 may also be more clearly understood by reference to FIG. 3. As shown, carriage 30 is preferably an inverted U-shaped member. An integral flange 50 extends outwardly from the inverted U-shaped portion or carriage 30, and a second flange 52 extends outwardly from the other edge of the inverted U-shaped portion. Flange 50 is disposed in slot 44 and flange 52 is disposed in slot 46. The surface opening of slots 44 and 46 are smaller than the channel portions thereof, with the result that there is an overhanging ridge 54 associated with slot 44 and a similar overhanging ridge 56 associated with slot 46.

As shown, flange 50 fits in loose contact in slot 44 and flange 52 fits in loose contact in slot 46, so that retaining carriage 30 may be slid along main rail 18. Ridges 54 and 56 prevent flanges 50 and 52 respectively from coming out of slots 44 and 46.

It can be seen that flanges 50 and 52 have different shapes, and that slots 44 and 46 are shaped corresponding respectively to flanges 50 and 52. This difference in shape is related to the manner of attaching checks to carriage 30. As will be discussed below, at a certain position along rail 18, ridge 56 is reduced so that flange 52 may be raised out of slot 46. Carriage 30 may then be rotated approximately 90° in a counter-clockwise direction, so that flange 30 is in an upright position. Each of the checks 34 has a specially provided slot 58 in the stub end thereof. The slots 58 may be placed over the raised flange 52. When flange 52 is then returned to and locked into slot 46, the checks are retained by carriage 30. The check cover plate 20 also has a slot 60 to accomodate the inverted U-shaped portion of carriage 30. The slots 58, 60 also allow the stack of checks 32 and plate 20 to be flipped back to the left and out of the way while writing on check 34.

When carriage 30 is rotated approximately 90° counter-clockwise to insert checks thereon, flange 50 pivots upward out of slot 44. A detent 62 on flange 50 prevents flange 50 from coming entirely out of slot 44, by contact with ridge 54 when carriage 30 has been rotated approximately 90° counter-clockwise.

Figure 4:
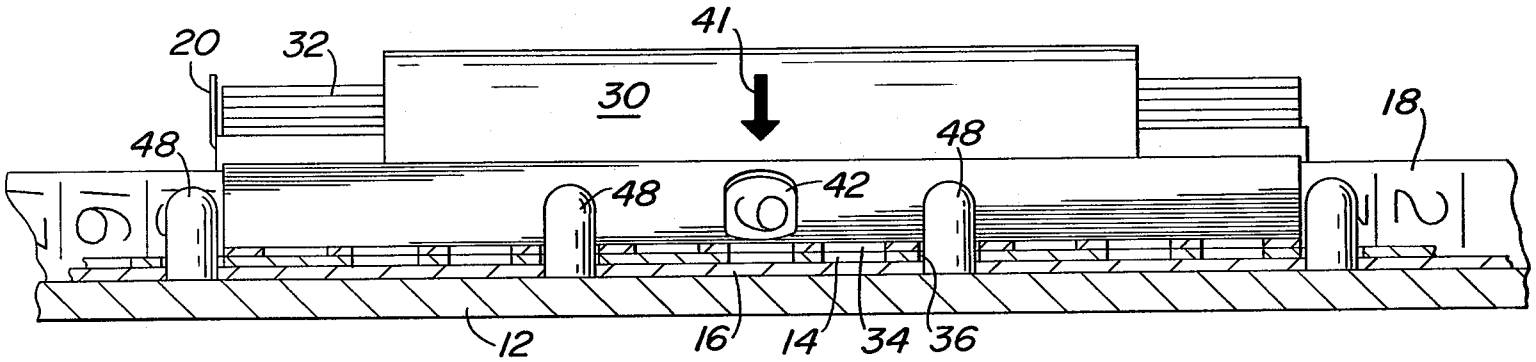
FIG. 4 is a sectional view taken along the line 4—4 in FIG. 3.

Referring now to FIG. 4, it may be seen that there are provided a plurality of posts 48. Posts 48 are preferably spaced at regular intervals and sufficiently close so that each check will be positioned over at least two and occasionally three posts.

FIG. 5 shows a check 34 of the type described above, having a narrow elongated slot 58 in the stub end thereof for fitting over flange 52, whereby the check 34 may be retained on carriage 30. The specially provided spaced holes 36, and the indexing hole 42 are also shown.

In the preferred embodiment, flange 52 has an increased width section 66, and ridge 56 has a decreased width section 68. Sections 66 and 68 cooperate to form a release point at which flange 52 may be raised out of slot 46, to allow the insertion of checks 34 onto carriage 30. As shown, main rail 18 is preferably an integral element machined from an aluminum bar. An end plate 70 may be attached at each end of rail 18 to prevent carriage 30 from falling out of the slots.

The operation of posting board 10 should be apparent from the above description. A stack of blank checks may be placed on carriage 30, and a business form 14 aligned on a writing surface 16 by pegs 48 and holes 28. The proper position of alignment may be determined by aligning the numbers in columns 22 and 24. Carriage 30 and attached checks may be slid along main rails 18 to the uppermost position, and the first check roughly aligned with the first position by indexing hole 42 and index pointer 41. Precise alignment and retention in position is accomplished by placing holes 36 over posts 48. Information written on line 38 is automatically duplicated on the underlying line of form 14. Check 34 may then be detached by tearing apart perforations separating the voucher portion of the check from the stub end. The stub end may then be torn free and discarded, and carriage 30 slid downward to the second position where the process is repeated.

After writing the number of checks desired, the remaining checks of the stack may be protected by flipping the cover plate 20 and the stack of checks 32 to the right over business form 14. Holes 36 of checks in the stack 32 may be engaged over posts 48. Then binder cover 12 may be closed, and the posting board placed aside until it will be used again.

It may be seen from the above description that there has been provided a very useful and very convenient device for posting checks or equivalent business entries. The present invention may be embodied in other specific forms without departing from the spirit or essential attributes thereof and, accordingly, reference should be made to the appended claims, rather than to the foregoing specification, as indicating the scope of the invention.

We claim:

1. A check posting board having a writing surface provided with a column of regularly spaced aligning posts by which checks may be aligned over a business form with duplicating material therebetween by placing discrete holes in the checks and business form over selected ones of the posts, including:

(a) an elongated rail member adjacent to an edge of the writing surface, the longitudinal axis of said rail member being parallel to the column of posts;

(b) two spaced parallel slots in an upper surface of the rail member extending substantially the length of the rail member; and (c) a carriage for retaining checks by stub ends thereof in a manner in which a check may be aligned over the business form by placing selected ones of the holes in the check stub over selective ones of the posts, wherein the check carriage is an inverted U-shaped member and has a flange disposed in sliding engagement in each of said slots whereby the carriage may be slid along the rail members and said flanges extend outwardly from the edges of the carriage, with the checks being retained by the inverted U-shaped member passing through a slot provided in the stub end of each check.

2. A check posting board as in claim 1, further comprising the slots in the main rail having a channel portion wider than the slot opening in the surface of the main rail whereby a ridge overhangs the channel portion and retains the flanges of the carriage therein.

3. A check posting board as in claim 2, wherein one of the slots in the main rail has a section where the width of the ridge is reduced thereby allowing the associated flange to be raised out of said slot so that checks may be placed over the U-shaped member.

4. A posting board as in claim 3, further comprising the opposite slot and associated flange being shaped to allow the U-shaped member to be rotated approximately 90° revolution to facilitate the placing of checks over the U-shaped member.

5. A posting board as in any one of claims 1, 2, 3 or 4, further comprising a column of numbered positions along the main rail to align therewith corresponding numbered lines on the business form.

6. A check posting board as in any one of claims 1, 2, 3 or 4, further comprising a binder cover of protective material covering the posting board.

* * * * *